US012490773B2

(12) United States Patent
Hepworth

(10) Patent No.: US 12,490,773 B2
(45) Date of Patent: Dec. 9, 2025

(54) CONSUMABLE VENTILATION CONTROL

(71) Applicant: NICOVENTURES TRADING LIMITED, London (GB)

(72) Inventor: Richard Hepworth, London (GB)

(73) Assignee: NICOVENTURES TRADING LIMITED, London (GB)

( * ) Notice: Subject to any disclaimer, the term of this patent is extended or adjusted under 35 U.S.C. 154(b) by 1045 days.

(21) Appl. No.: 16/765,118

(22) PCT Filed: Nov. 16, 2018

(86) PCT No.: PCT/EP2018/081536
§ 371 (c)(1),
(2) Date: May 18, 2020

(87) PCT Pub. No.: WO2019/096983
PCT Pub. Date: May 23, 2019

(65) Prior Publication Data

US 2020/0345075 A1 Nov. 5, 2020

(30) Foreign Application Priority Data

Nov. 16, 2017 (GB) ..... 1718923

(51) Int. Cl.
*A24F 40/20* (2020.01)
*A24F 40/46* (2020.01)
(Continued)

(52) U.S. Cl.
CPC ..... *A24F 40/53* (2020.01); *A24F 40/46* (2020.01); *A24F 40/485* (2020.01); *A24F 40/57* (2020.01);
(Continued)

(58) Field of Classification Search
None
See application file for complete search history.

(56) References Cited

U.S. PATENT DOCUMENTS 4,112,154 A * 9/1978 McCarty ..... A24C 5/565 156/291
2013/0284192 A1* 10/2013 Peleg ..... A24F 40/53 131/329
(Continued)

FOREIGN PATENT DOCUMENTS

CN 105446381 A 3/2016
CN 205358221 U 7/2016
(Continued)

OTHER PUBLICATIONS

International Search Report, Application No. PCT/EP2018/081536, mailed Mar. 19, 2019, 3 pages.
(Continued)

*Primary Examiner* — Katherine A Will
(74) *Attorney, Agent, or Firm* — MERCHANT & GOULD P.C.

(57) ABSTRACT

Disclosed is an apparatus for receiving an article including aerosolizable material and a ventilation region, in which apparatus the aerosolizable material can be heated to volatilize at least one component of the aerosolizable material to generate a flow of aerosol for inhalation by a user, and related systems and methods. The apparatus includes a housing into which the article can be inserted to be heated; a first opening in the housing to allow air to flow into the housing when the user draws on the apparatus or the article; and a first airflow control arrangement configured to, in use, when the article is inserted in the housing, control the amount of airflow through the first opening in the housing in order to control the amount of airflow passing into the article through the ventilation region.

19 Claims, 6 Drawing Sheets

(51) Int. Cl.

| | |
|---|---|
| ***A24F 40/485*** | (2020.01) |
| ***A24F 40/53*** | (2020.01) |
| ***A24F 40/57*** | (2020.01) |
| *A24D 1/20* | (2020.01) |
| *A24F 40/60* | (2020.01) |

(52) U.S. Cl.
CPC ..... *A24D 1/20* (2020.01); *A24F 40/20* (2020.01); *A24F 40/60* (2020.01)

(56) References Cited

U.S. PATENT DOCUMENTS

| | | | | |
|---|---|---|---|---|
| 2014/0338686 | A1* | 11/2014 | Plojoux ..... | A24F 40/485 131/329 |
| 2015/0351457 | A1 | 12/2015 | Liu | |
| 2016/0213065 | A1 | 7/2016 | Wensley | |
| 2017/0368273 | A1 | 12/2017 | Rubin | |
| 2022/0241523 | A1 | 8/2022 | Davidson et al. | |

FOREIGN PATENT DOCUMENTS

| | | | |
|---|---|---|---|
| CN | 105852229 | A | 8/2016 |
| CN | 105446381 | B | 5/2018 |
| GB | 2412876 | | 10/2005 |
| JP | 2014533932 | A | 12/2014 |
| JP | 2016195585 | A | 11/2016 |
| JP | 2017526405 | A | 9/2017 |
| WO | 2013083635 | A1 | 6/2013 |
| WO | WO 2013102609 | | 7/2013 |
| WO | WO 2016066635 | | 5/2015 |
| WO | WO 2015165105 | | 11/2015 |
| WO | WO 2015180058 | | 12/2015 |
| WO | WO 2016012774 | | 1/2016 |
| WO | WO 2016040575 | | 3/2016 |
| WO | WO 2016075436 | | 5/2016 |
| WO | WO 2016135271 | | 9/2016 |

OTHER PUBLICATIONS

International Preliminary Report on Patentability received for PCT Patent Application No. PCT/EP2018/081536, completed on May 28, 2020, 8 pages.

Written Opinion received for PCT Patent Application No. PCT/EP2018/081536, mailed on Mar. 19, 2019, 6 pages.

"Office Action received for Japanese Patent Application No. 2020526997, mailed on Jun. 8, 2021", 14 pages (7 pages of English Translation and 7 pages of Official Copy).

"Reason for Refusal received for Korean Patent Application No. 10-2020-7013868, mailed on Jan. 6, 2022", 11 pages (6 pages of English Translation and 5 pages of Official Copy).

* cited by examiner

600

| 602 Puff Number | 604 Air inlet size | 606 Apparatus air intake (%) | 608 Consumable ventilation air intake (%) |
|---|---|---|---|
| 1 | 90% closed | 20 | 80 |
| 2 | 80% closed | 30 | 70 |
| 3 | 60% closed | 40 | 60 |
| 4 | 40% closed | 60 | 40 |
| 5 | Open | 75 | 25 |

Figure 6

CONSUMABLE VENTILATION CONTROL

PRIORITY CLAIM

The present application is a National Phase entry of PCT Application No. PCT/EP2018/081536, filed Nov. 16, 2018, which claims priority from GB Patent Application No. 1718923.4, filed Nov. 16, 2017, which is hereby fully incorporated herein by reference.

TECHNICAL FIELD

The present disclosure relates to control of the ventilation of a consumable article.

BACKGROUND

Articles such as cigarettes, cigars and the like burn tobacco during use to create tobacco smoke. Attempts have been made to provide alternatives to these articles, which articles burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

SUMMARY

According to a first aspect of the present disclosure, there is provided an apparatus for receiving an article comprising aerosolizable material and a ventilation region, in which apparatus the aerosolizable material can be heated to volatilize at least one component of said aerosolizable material to generate a flow of aerosol for inhalation by a user, the apparatus comprising: a housing into which the article can be inserted to be heated; a first opening in the housing to allow air to flow into the housing when the user draws on the apparatus or the article; and a first airflow control arrangement configured to, in use, when the article is inserted in the housing, control the amount of airflow through the first opening in the housing in order to control the amount of airflow passing into the article through the ventilation region.

The first airflow control arrangement may comprise an airflow control mechanism configured to control the airflow through the first opening by varying the size of the first opening.

The first airflow control arrangement may comprise a first restrictor mechanism operatively connected to a first actuator configured to actuate the first restrictor mechanism.

The apparatus may comprise a controller configured to control ventilation of the article inserted into the apparatus by controlling the operation of the first airflow control arrangement.

The apparatus may comprise a monitor for use in determining the progress of a use session.

The monitor may be a pressure sensitive device configured to count the number of times the volatilized at least one component of aerosolizable material is drawn from the system.

The controller may control the first airflow control arrangement on the basis of the progress of the use session determined using the monitor.

The controller may be configured to control the first airflow control arrangement to allow a given amount of airflow through the first opening at the beginning of a use session, and to control the first airflow control arrangement to increase the amount of airflow through the first opening as the use session progresses.

The apparatus may comprise a setting input arrangement configured to receive an indication of settings for varying the amount of airflow through the first opening as the use session progresses and wherein, the controller may be configured to control the first airflow control arrangement based on settings received via the setting input arrangement.

The ventilation region may be positioned within the apparatus when the article is inserted into the apparatus, and the housing may comprise a second opening to allow air to flow to the ventilation region.

The apparatus may comprise a second airflow control arrangement configured to, in use, when the article is inserted in the housing, control the amount of airflow through the second opening in the housing in order to control the amount of airflow passing into the article through the ventilation region.

The apparatus may comprise at least one heater arrangement within the housing for heating the aerosolizable material of the article.

According to a second aspect of the present disclosure, there is provided a method of controlling the ventilation of an article inserted into an apparatus for heating aerosolizable material to volatilize at least one component of said aerosolizable material to generate a flow of aerosol for inhalation by a user, the method comprising varying an amount of airflow through an air inlet of the apparatus in order to vary an amount of ventilation airflow passing into the article through a ventilation region in the article.

The method may comprise: identifying the start of a use session; and setting an initial amount of ventilation of the article by setting an initial airflow through the air inlet of the apparatus.

The method may comprise repeatedly: determining the progress of the use session; and varying the ventilation of the article by varying the airflow through the air inlet of the apparatus based on the progress of the use session until a ventilation threshold is reached.

According to a third aspect of the present disclosure, there is provided a system for heating aerosolizable material to volatilize at least one component of said aerosolizable material to generate a flow of aerosol for inhalation by a user, the system comprising: an article comprising a body of aerosolizable material and a ventilation region to enable a flow of air into the article; and an apparatus in which the aerosolizable material of the article can be heated, the apparatus comprising: a housing into which the article can be inserted to be heated; an opening in the housing to allow air to flow into the housing when the user draws on the apparatus or the article; and an airflow control arrangement configured to, in use, when the article is inserted in the housing, control the amount of airflow through the opening in the housing in order to control the amount of airflow passing into the article through the ventilation region.

BRIEF DESCRIPTION OF THE DRAWINGS

Embodiments of the disclosure will now be described, by way of example only, with reference to the accompanying drawings, in which:

FIG. 6 is a table indicating a correspondence relationship between the progress of a use session and consumable ventilation.

DETAILED DESCRIPTION

As used herein, the term "aerosolizable material" includes materials that provide volatilized components upon heating, typically in the form of an aerosol. "Aerosolizable material" includes any tobacco-containing material and may, for example, include one or more of tobacco, tobacco derivatives, expanded tobacco, reconstituted tobacco or tobacco substitutes. "Aerosolizable material" also may include other, non-tobacco, products, which, depending on the product, may or may not contain nicotine. "Aerosolizable material" may for example be in the form of a solid, a liquid, a gel or a wax or the like. "Aerosolizable material" may for example also be a combination or a blend of materials. In some examples, the aerosolizable material is a gel. In some example, the aerosolizable material is a liquid and may, for example, be provided in a suitable container for use with apparatus for heating aerosolizable material.

Apparatus is known that heats aerosolizable material to volatilize at least one component of the aerosolizable material, typically to form an aerosol which can be inhaled, without burning or combusting the aerosolizable material. Such apparatus is sometimes described as a "heat-not-burn" apparatus or a "tobacco heating product" or "tobacco heating device" or similar. Similarly, there are also so-called e-cigarette devices, which typically vaporize an aerosolizable material in the form of a liquid, which may or may not contain nicotine. The aerosolizable material may be in the form of or be provided as part of a rod, cartridge or cassette or the like which can be inserted into the apparatus. In some examples, a heater for heating and volatilizing the aerosolizable material may be provided as a "permanent" part of the apparatus or may be provided as part of an article comprising aerosolizable material or consumable which is discarded and replaced after use. An "article comprising aerosolizable material" or "consumable article" in this context is a device or article or other component that includes or contains in use the aerosolizable material, which is heated to volatilize the aerosolizable material to generate a flow of aerosol for inhalation by a user, and optionally other components in use.

Figure 1:
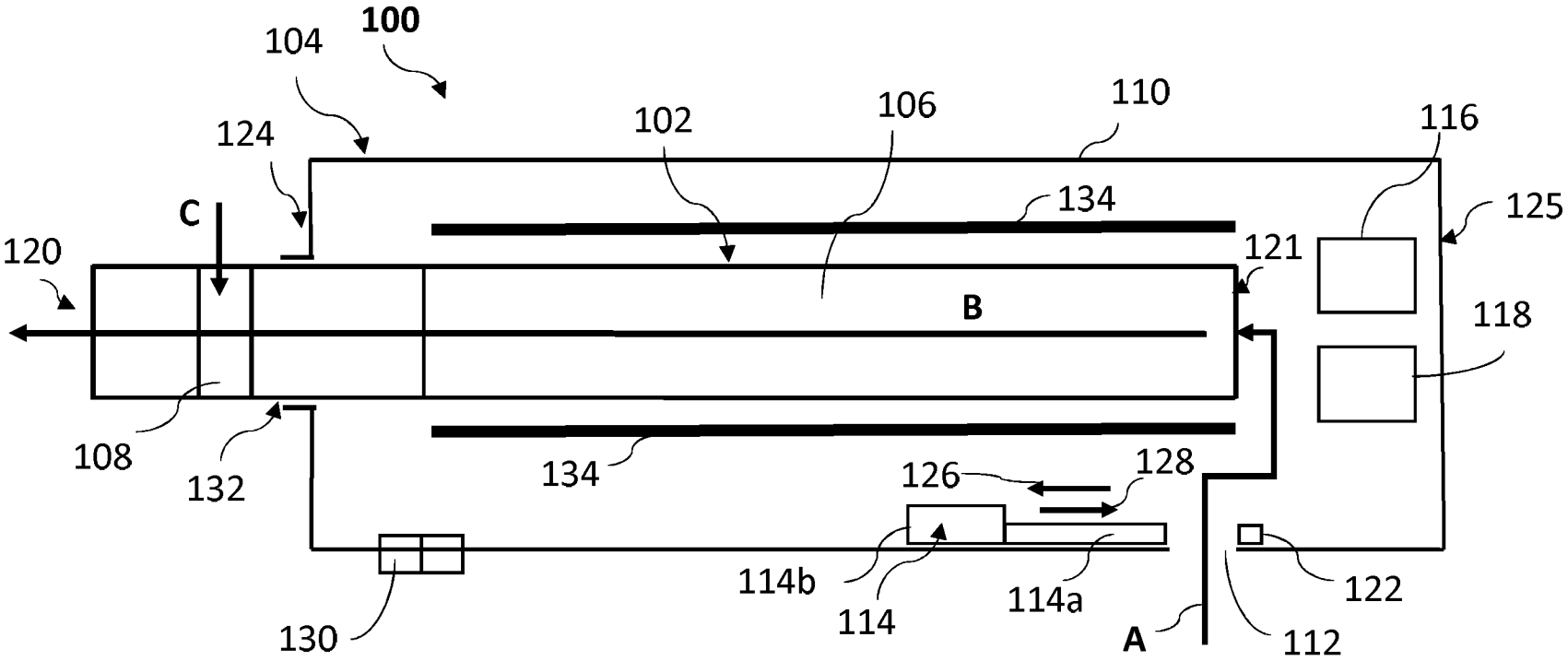
FIG. 1 illustrates schematically a first system for heating aerosolizable material.
Figure 2:
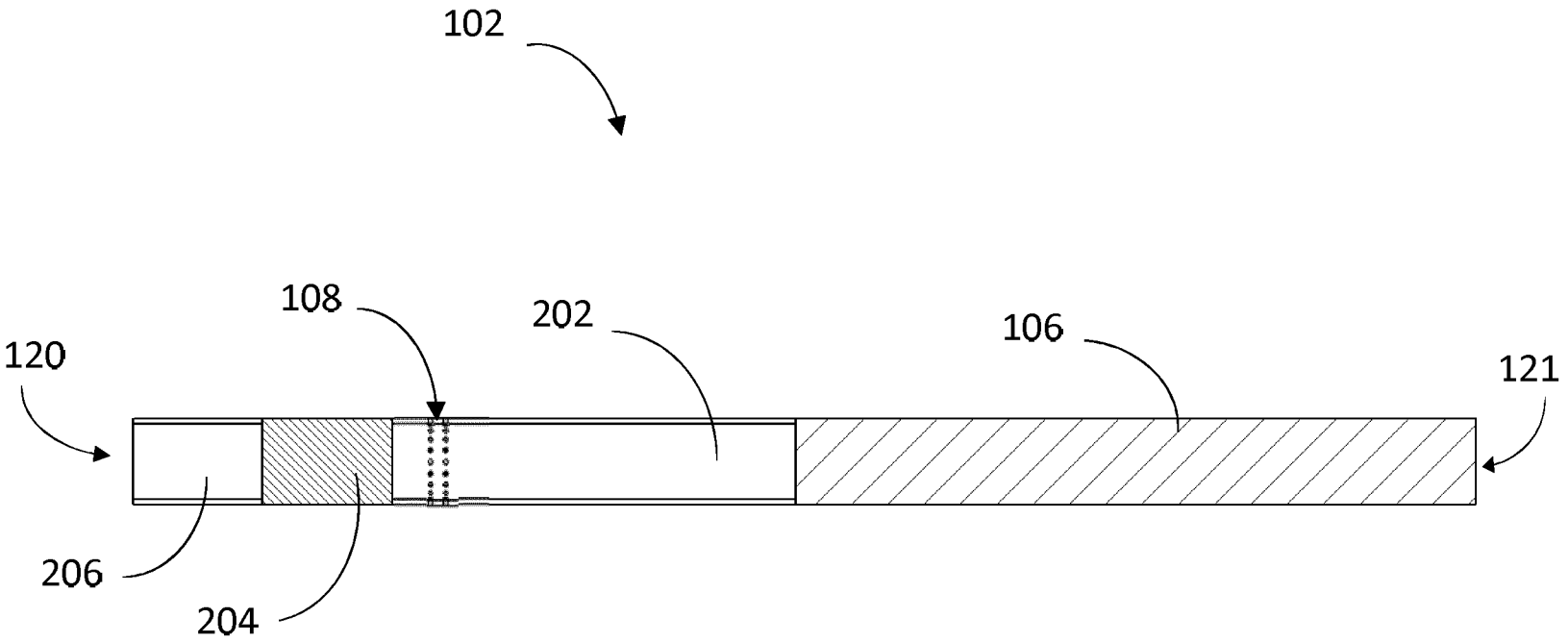
FIG. 2 illustrates a consumable article for use with the system of FIG. 1.
Figure 3:
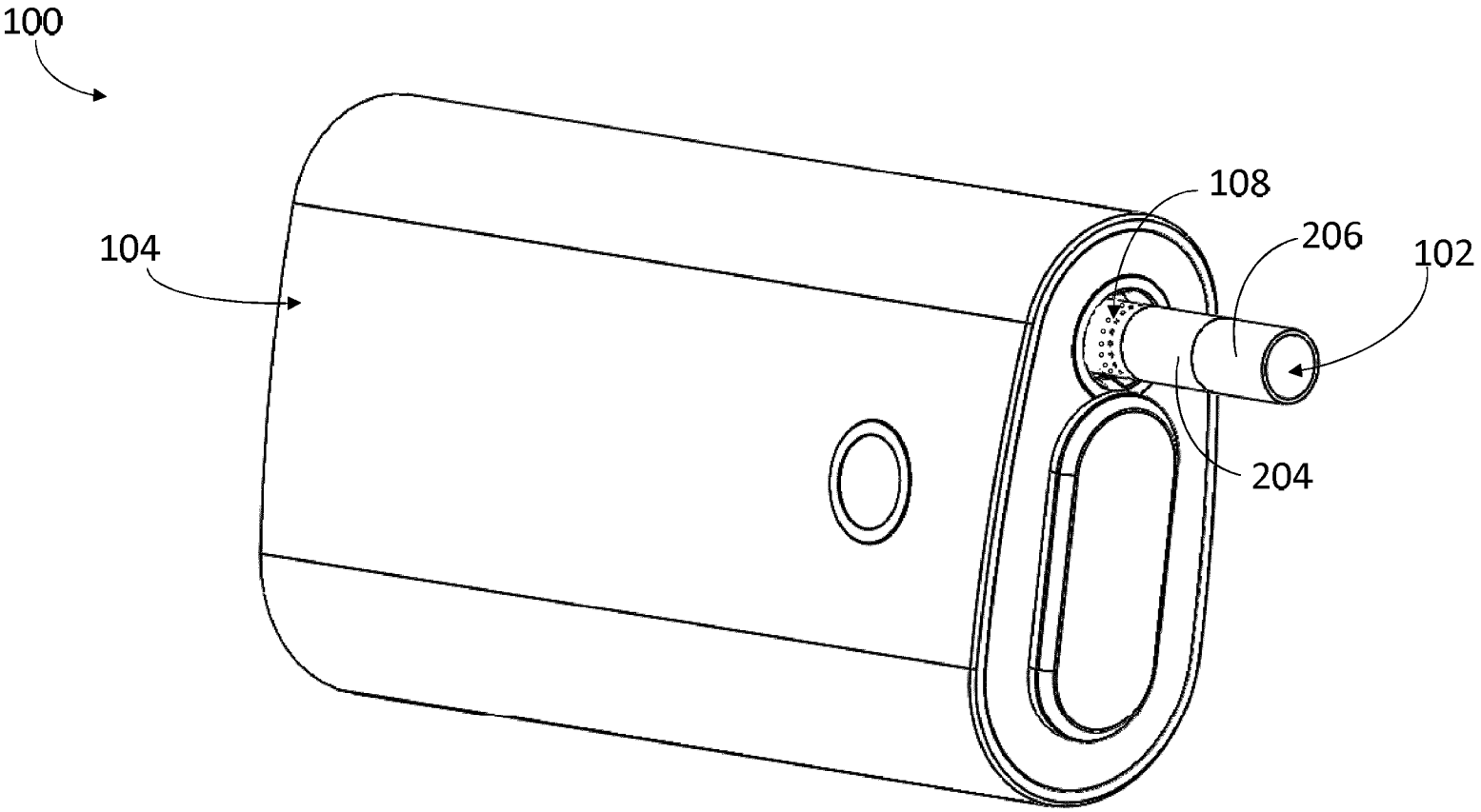
FIG. 3 illustrates an external view of the system of FIG. 1.

Referring to FIGS. 1 to 3, a system 100 arranged to heat aerosolizable material to volatilize at least one component of said aerosolizable material to generate a flow of aerosol for inhalation by a user is schematically shown.

The system 100 comprises an aerosol provision device or apparatus 104 and an aerosol provision article or consumable 102 that can be inserted into the apparatus 104. The system 100 is an inhalation system (i.e. a user uses the system to inhale an aerosol provided by the system 100). The apparatus 104 is a hand holdable apparatus.

The consumable article 102 comprises aerosolizable material 106 and a ventilation region 108 to enable a flow of air into the consumable article 102. In the example shown in FIGS. 1 to 3, aerosolizable material 106 forms a segment at a distal end 121 of the consumable article 102.

In very broad outline, the system 100 generates a vapor or an aerosol from the aerosolizable material 106 which passes from the system 100 into the mouth of a user when the user draws on the system 100.

In this respect, first it may be noted that, in general, a vapor is a substance in the gas phase at a temperature lower than its critical temperature, which means that, for example, the vapor can be condensed to a liquid by increasing its pressure without reducing the temperature. On the other hand, in general, an aerosol is a colloid of fine solid particles or liquid droplets, in air or another gas. A colloid is a substance in which microscopically dispersed insoluble particles are suspended throughout another substance. For reasons of convenience, as used herein the term aerosol should be taken as meaning an aerosol, a vapor or a combination of an aerosol and vapor.

The apparatus 104 is for heating, but not burning, the aerosolizable material 106 comprised in the consumable article 102. The apparatus 104 comprises a housing 110 for locating and protecting various components of the apparatus 104. The housing 110 may, for example, be an insulated housing such that the housing 110 does not become uncomfortably hot to touch. The housing 110, for example, comprises an air impermeable material such that air substantially does not flow in or out of the housing except through the intended air inlets or outlet provided in the housing 110.

The housing 110 comprises a first end 124 referred to herein as a mouth or proximal end 124 and a second end 125 referred to herein as a distal end 125.

At the proximal end 124, the housing 110 comprises an opening 132 through which, in use, a user can insert the consumable article 102 into the apparatus 104 and later remove the consumable article 102 from the apparatus 104. In this example, when the consumable article 102 is inserted into the housing 110 part of the consumable article 102 extends outside of the housing 110.

In the example of FIG. 1, the housing 110 contains a heater arrangement 134 to heat, but not burn, the aerosolizable material 106 in order to volatilize at least one component of the aerosolizable material 106. The heater arrangement 134 may, for example, be in the form of a hollow cylindrical tube having a hollow interior chamber into which the tobacco containing segment 106 of the consumable article 102 is positioned. Different arrangements for the heater arrangement 134 are possible. For example, the heater arrangement 134 may comprise a single heating element or may be formed of plural heating elements aligned along the longitudinal axis of the heater arrangement 134. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating arrangements, infrared heater elements which heat by emitting infrared radiation, or resistive heating elements formed by for example a resistive electrical winding.

In one particular example, the heater arrangement 134 is formed of a polyimide substrate on which is formed one or more heating elements and which is supported by a stainless steel support tube.

In examples in which the heater arrangement 134 is an inductive heating arrangement, the heater arrangement 134 may comprise one or more inductor coils which are operated to heat one or more susceptor elements. In such examples, the inductor coils cause the susceptor elements to generate heat by providing energy to the susceptor elements. It will be understood that an inductive heating arrangement can comprise separate components, namely inductor coils and susceptor elements, that may be provided separately as part of separate components of the system 100. In some examples, the housing 110 may comprise inductor coils for an inductive heating arrangement, and susceptor elements may be provided elsewhere, for example, within or as part of the consumable article 120.

The housing 110 further contains control circuitry 116 for controlling components of the apparatus 104 and a power source 118 for powering components of the apparatus 104. The control circuitry 116 may, for example, comprise a microprocessor for providing the various control functions describe herein.

The housing 110 further comprises an opening 112, in this example located towards the distal end 125 of the housing 110, to allow air to flow into the housing 110 when the user draws on the consumable article 102. The opening 112 may also be referred to as a first air inlet 112. The apparatus 104 also comprises a first airflow control arrangement 114 configured under the control of the control circuitry 116 to control, in use of the system 100, the amount of airflow through the first air inlet 112 in the housing 110 in order to, as will be explained in more detail below, control the amount of airflow into the consumable article 102 through the ventilation region 108. Those skilled in the art will appreciate that the term "airflow" in this context means the volume of air passing a given point in space per unit time.

As best shown in FIG. 2, in this example, the consumable article 102 is in the form of an elongate rod with the aerosolizable material 106 provided as a segment at the distal end 121 of the consumable article 102. The consumable article 102 further comprises a mouthpiece or proximal end 120 and the ventilation region 108 is between the proximal end 120 and aerosolizable material 106 in a cooling segment 202. In this example, the consumable article 102 also comprises a filter segment 204 between the cooling segment 202 and the mouthpiece end 120. In this example, the ventilation region 108 is provided in the cooling segment 202 and comprises a plurality of ventilation holes arranged in two circumferential rows that allow air to flow into the cooling segment 204.

In use, at least one component of the aerosolizable material 106 is volatilized in the segment containing the aerosolizable material 106 and cools and mixes with air in the cooling segment 202 such that aerosol suitable for inhalation is generated. The aerosol then flows through the filter segment 204 as it is drawn by a user from a mouth end segment 206 at the proximal end 120 of the consumable article 102.

Although in the example of FIG. 2, a ventilation region 108 is provided in the cooling segment 202, in other examples, the ventilation region 108 may be provided at another part of the consumable article 102. For example, the ventilation region 108 may be provided in the segment containing the aerosolizable material 106. In this case, air would flow directly into the segment of aerosolizable material 106 to mix with the volatilized at least one component of the aerosolizable material 106. In some examples, the consumable article may not comprise a specific cooling segment 202.

In this example, when the consumable article 102 is inserted in the apparatus 104, the aerosolizable material 106 is within the heating arrangement 134 in the housing 110, and the proximal end 120 and the ventilation region 108 extend outside of the housing 110.

In use, when the heating arrangement is powered, which may be instigated, for example, by a user using a user input means 130, for example a control button, pad, touch screen or the like on the housing 110 or a monitor 122 (which may, for example be a pressure sensitive device such as a puff detector, or a microphone) within the housing 110, the control circuitry 116 controls the heating arrangement to heat the aerosolizable material 106 so as to volatize at least one component of the aerosolizable material 106.

As the user draws on the proximal end 120 of the consumable article 102, air is drawn into the apparatus 104 through the first air inlet 112 and into the aerosolizable material 106 as indicated by the arrow A.

The volatized at least one component of the aerosolizable material mixes with the air to produce a flow of aerosol which flows through the consumable article 102, as indicated by the arrow B, and into the mouth of the user.

As the flow of aerosol flows through the consumable article 102, cool air flows into the consumable article 102 through the ventilation region 108, as shown by arrow C, into the cooling section 202 and helps cool the flow of aerosol prior to the flow of aerosol entering the user's mouth.

As mentioned above, the system 100 is arranged so that the amount of ventilation air flowing into the consumable article 102 through the ventilation region 108 depends upon the airflow into the device 104 through the first air inlet 112.

On any given puff, the airflow into the device 104 through the first air inlet 112 depends upon the first airflow control arrangement 114. The first airflow control arrangement 114 may, for example, comprise an airflow control mechanism comprising a first restrictor mechanism **114*a* which varies the size of the first air inlet 112 to vary the airflow allowed through the first air inlet 112. The first airflow restrictor mechanism 114*a* may, for example, comprise a type of valve that allows air to flow into the apparatus 104. For example, the first restrictor mechanism 114*a*** may be a needle valve. Other examples of restrictor mechanisms include sliding valves, rotatable valves and the like.

In the example of FIG. 1, for the purpose of illustration, the first restrictor mechanism **114*a* is shown as a simple movable element which moves in the directions indicated by arrows 126 and 128 in order to increase or decrease, respectively, the size of the first air inlet 112. However, it will be understood that any suitable mechanism for increasing or decreasing the airflow through the first air inlet 112 may be used. The restrictor mechanism is operatively connected to a first actuator 114*b* configured to actuate the first restrictor mechanism 114*a*. The first actuator 114*b* actuates the first restrictor mechanism 114*a* to increase or decrease the size of the first air inlet 112 by causing the first restrictor mechanism 114*a* to move in the direction of the arrows 126 and 128 respectively in this example. The first actuator 114*b* may, for example, be a motor which actuates the first restrictor mechanism 114*a***.

In the example of FIG. 1, when the user draws on the consumable article 102, if, for example, the first restrictor mechanism **114*a* is positioned so that the size (e.g. the area of the first air inlet 112) is relatively small (in other words the first restrictor mechanism 114*a* is positioned more in the direction of arrow 128), a relatively small amount of airflow flows through the first air inlet 112. In this case, to compensate for the air drawn by the user from the consumable article 102 (and consequently also the apparatus 104), a relatively large airflow flows into the consumable article 102 through the ventilation region 108**, thus increasing consumable ventilation.

On the other hand, if, for example, when the user draws on the consumable article 102, the first restrictor mechanism 114*a* is positioned so that the size of the first air inlet 112 is relatively large (in other words the first restrictor mechanism 114*a* is positioned more in the direction of arrow 126), a relatively large amount of airflow flows through the first air inlet 112. In this case, to compensate for the air drawn by the user from the consumable article 102 (and consequently also the apparatus 104), a relatively small amount of airflow flows into the consumable article 102 through the ventilation region 108, thus reducing consumable ventilation.

It will therefore be understood that the first restrictor mechanism 114*a* being positioned to decrease airflow through the first air inlet 112 causes increased ventilation of the consumable article 102 when the user draws on the consumable article 102 and, conversely, the first restrictor mechanism 114*a* being positioned to increase airflow through the first air inlet 112 causes decreased ventilation of the consumable article 102 when the user draws on the consumable article 102. Accordingly, the consumable ventilation may be controlled by varying the amount of airflow allowed through the first air inlet 112 (in this example, by varying the size of the first air inlet 112).

As will be appreciated by those skilled in the art, in use of the system 100, varying the amount of ventilation airflow into the consumable article 102 through the ventilation region 108 will vary one or more properties of the aerosol flow flowing from the consumable article 102 into the mouth of a user. For example, the temperature of the aerosol flow into the mouth of a user may be varied. In general, the greater the amount of air flowing into the consumable article 102 through the ventilation region 108 the lower the temperature of the aerosol flow flowing into the mouth of a user. Varying the amount of ventilation airflow into the consumable article 102 through the ventilation region 108 may also vary the taste of the aerosol flow as perceived by the user. Also, for example, varying the consumable ventilation may also vary the visibility of the aerosol provided by the system 100.

In one example, the user input means 130 is a setting input arrangement configured to receive an indication of settings for varying the airflow through the first air inlet 112 as the use session progresses and wherein, the controller is configured to control the first airflow control arrangement based on settings received via the setting input arrangement. For example, a user may use the user input means 130 to cause the control circuitry 116 to control the first airflow control arrangement 114 to set a required size of the first air inlet 112.

In one example, the apparatus 104 comprises a manual control (not shown) by means of which a user may manually set the size of the first air inlet 112 by physically manipulating the first restrictor mechanism 114*a*. For example, the manual control mechanism may comprise buttons, switches, or other mechanisms that would allow the user of the system 100 to actuate the first airflow control arrangement 114.

In some examples, the control circuitry 116 may be arranged to automatically control the first airflow control arrangement 114 throughout at least a part of a user's use session to vary the size of the first air inlet 112 and hence vary the amount of ventilation airflow into the consumable article 102 through the ventilation region 108.

In some examples, the control circuitry 116 is configured to control the first airflow control arrangement 114 so as to allow a relatively small amount of airflow through the first air inlet 112 (and hence a relatively large amount of airflow through the ventilation region 108) at the beginning of a user's use session and then to increase the amount of airflow through the first air inlet 112 (and hence decrease the amount of consumable ventilation) as the use session progresses.

It is known that when using Tobacco Heating Product devices, during the initial stage of a use session when the heater has been activated and a user is taking his or her first or initial few puffs, the temperature of the aerosol flow through the consumable (or device) may be higher than it is later on in the use session (e.g. after the user has taken his or her first or initial few puffs). Advantageously, providing a relatively large amount of ventilation air flowing through the ventilation region 108 at the beginning of the use session (which cools the aerosol flow) helps mitigate against the possibility that aerosol flow flowing into a user's mouth that is uncomfortably hot.

By then gradually or incrementally decreasing the consumable ventilation as the use session progresses until a steady state amount of ventilation is reached, the amount of cooling provided by the ventilation is decreased at the same time that the temperature of the aerosol flow naturally decreases to a steady state value with the net effect that the temperature of the aerosol flow perceived by a user is substantially constant throughout the use session. Incrementally decreasing the consumable ventilation may include one or more increments.

In one example, the control circuitry 116 is configured to control the first actuator 114*b* so that during an apparatus initialization phase (i.e. a phase after the apparatus 104 has been switched on but before a use session begins) to move the first restrictor mechanism 114*a* to a first position (if it is not there already) in which the size of the first air inlet 112 is relatively small (e.g. 10% of the maximum possible size of the inlet 112) and then to gradually or incrementally increase the size of the inlet 112 as the use session progresses by moving first restrictor mechanism 114*a* in the direction of the arrow 126 until a final size of the first air inlet 112 is reached (say 90% of the maximum possible size of the first air inlet 112).

In one example, the control circuitry 116 is configured to incrementally increase the size of the first air inlet 112 as the use session progresses by incrementally moving the first restrictor mechanism 114*a* from the first position to the final position in dependence upon signals from the monitor 122 that is monitoring the use session. In one example, the size of first air inlet 112 may be increased in a single increment from a relatively small size (mostly closed) to a relatively large size (mostly open) to accordingly decrease the consumable ventilation. The monitor 122 may be the puff detector 122, so for example, each time the puff detector 122 signals that a puff has been detected, the control circuitry 116 increases the size of the first air inlet 112 until after a pre-determined number of puffs (say 4) has been taken and the first air inlet 112 is fully open. In another example, the first air inlet 112 may be mostly closed for the first 3 puffs and subsequently may be mostly open.

In other examples, the control circuitry 116 is configured to incrementally or gradually increase the size of the first air inlet 112 as the use session progresses by incrementally or gradually moving the first restrictor mechanism 114*a* from the first position to the final position in dependence upon a timer.

In one such example, the control circuitry 116 is configured to maintain a relatively small size (or a minimum size) of the first air inlet 112 for the first 60 seconds of a use session.

Subsequently to the first 60 seconds, the control circuitry 116 may incrementally or gradually increase the size of the first air inlet 112 to reduce consumable ventilation. An incremental increase in size of the first air inlet 112 may include one or more increments.

In another example, the control circuitry 116 is configured to maintain a relatively small (or a minimum size) of the first air inlet 112 for the first 10 to 50 seconds of a use session before gradually or incrementally increasing the size of the first air inlet 112 to decrease consumable ventilation.

In yet another example, the control circuitry 116 is configured to maintain a relatively small size (or a minimum size) of the first air inlet 112 for the first 20 to 40 seconds of a use session before gradually or incrementally increasing the size of the first air inlet 112 to decrease consumable ventilation.

In examples in which a manual control mechanism is provided in the apparatus 104 for the user to manually control the airflow control arrangement, the user is able to control the aerosol temperature, flavor, visibility of aerosol, or any other aerosol characteristic dependent on the consumable ventilation manually by controlling the airflow control arrangement as the use session progresses.

As described above, the consumable ventilation may be controlled in order to manage the temperature of the aerosol provided to a user. In some examples, the consumable ventilation may be controlled in order to manage the flavor of the aerosol as the use session progresses. For constant consumable ventilation during the use session, the aerosol flavor may vary as explained in the following. In examples where more than one component of the aerosolizable material 106 is volatilized, the composition of the volatilized components of the aerosolizable material 106 may change as the use session progresses. For example, a first combination of components of the aerosolizable material 106 may be volatilized at the beginning of the use session, and as the use session progresses, a second combination of components may be volatilized. This may, for example, occur if a volatilizable component is no longer present in a sufficient quantity such that it can be volatilized part of the way through the use session. This changing composition of the volatilized components as the use session progresses may cause variation of the taste of the aerosol as the use session progresses.

In examples in which one component of the components of the aerosolizable material 106 is volatilized, the rate at which that component of the aerosolizable material 106 is volatilized may vary as the use session progresses. In such examples, for a given constant amount of ventilation of the consumable article 102 throughout the use session, the flavor of the aerosol may change as the use session progresses.

It will be understood that the amount of air flowing in through the ventilation region 108 and mixing with the aerosol affects the flavor of the aerosol provided to the user. Thus, the flavor of the aerosol may be managed by controlling the consumable ventilation based on the progress of the use session.

In the example of FIGS. 1 to 3, the ventilation region 108 is provided at a part of the cooling segment 202 of the consumable article 102 which extends out from the apparatus 104 when the consumable article 102 is inserted into the apparatus 104. However, as mentioned above, the ventilation region may be provided at another part of the consumable article 102. For example, the ventilation region 108 may be provided in the segment containing the aerosolizable material 106. For example, the ventilation region 108 may not be provided at a part of the consumable article 102 that extends out from the apparatus 104 when the consumable article 102 is inserted into the apparatus 104.

Although in the above examples, the consumable article 102 extends out of the apparatus 104 when inserted into the apparatus 104 in use and a user draws on the mouth end segment 206, in other examples, the consumable article 102 may not extend outwards from the apparatus 104. Instead, the apparatus 104 may comprise a mouthpiece on which the user can draw to inhale the aerosol.

Thus, in some examples, the ventilation region 108 is positioned within the apparatus 104 when the consumable article 102 is inserted into the apparatus 104.

Figure 4:
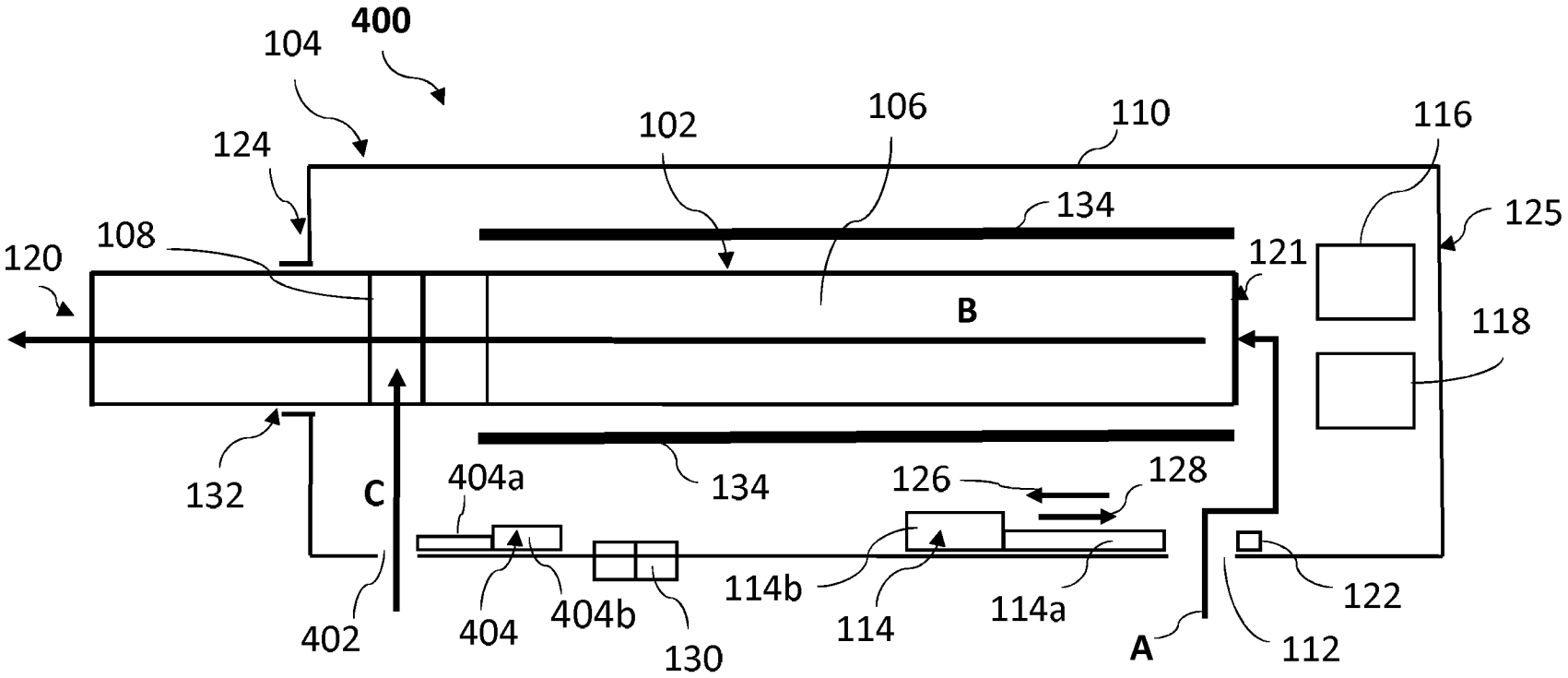
FIG. 4 illustrates schematically a second system for heating aerosolizable material.

In examples in which the ventilation region 108 is provided at a part of the consumable article 102 that is inserted into the apparatus 104, the housing 110 may comprise additional air inlets to allow consumable ventilation. FIG. 4 illustrates an example of a system 400, similar to the system 100. The description of elements of system 400 already described above with respect to system 100 is omitted for brevity, and like elements are labelled with the same reference numerals in FIG. 4 as they are in FIG. 1. In system 400, the consumable article 102 comprises a ventilation region 108 disposed such that the ventilation region is positioned within the apparatus 104 when the consumable article 102 is inserted into the apparatus 104. In this example, the housing 110 comprises a second air inlet (a second opening) 402 to allow air to flow to the ventilation region 108. The second air inlet 402 functions as a ventilation inlet such that air enters the housing 110 through the second air inlet 402 and then enters the ventilation region 108 of the consumable article 102. In the example of FIG. 4, the second air inlet 402 is aligned with the ventilation region 108, and air may flow into the ventilation region 108 after entering through the second air inlet 402 as shown by arrow C. In other examples, the second air inlet 402 may not necessarily be aligned with the position of the ventilation region 108 of an inserted consumable article 102, however, an airflow path between the second air inlet 402 and the ventilation region 108 of the inserted consumable article 102 may be defined within the apparatus 104.

The system 400 shown in the example of FIG. 4 may function in the same manner as described above with respect to system 100 shown in FIG. 1. However, the system 400 of the example of FIG. 4 may allow further control of the consumable ventilation as follows. In the example of FIG. 4, the apparatus 104 comprises a second airflow control arrangement 404 to control the amount of airflow through the second air inlet 402 in use of the system 400. In other words, the second airflow control arrangement 404 is configured to, in use, when the article 102 is inserted in the housing 110, control the amount of airflow through the second air inlet 402 in the housing 110 in order to control the amount of airflow passing into the article 102 through the ventilation region 108. The second airflow control arrangement 404 may be controlled by the control circuitry 116 and/or manually controlled.

The second airflow control arrangement 404 may, for example, comprise a second restrictor mechanism **404*a* which varies the size of the second air inlet 402 to vary the airflow allowed though the second air inlet 402. The second restrictor mechanism 404*a* may, for example, comprise a type of valve that allows air to flow into the apparatus 104**.

For example, the second restrictor mechanism 404*a* may be a needle valve. Other examples of restrictor mechanisms include sliding valves, rotatable valves and the like. In this example, the second restrictor mechanism 404*a* is a movable element which moves to increase or decrease the size of the second air inlet 402 in a similar manner to the first restrictor mechanism 114*a* described above.

In this example, the second restrictor mechanism is operatively connected to a second actuator 404*b* which actuates the second restrictor mechanism 404*a* to increase or decrease the size of the second air inlet 402.

It will be appreciated that this particular example offers additional control over the ventilation of the consumable article 102. For example, when the second airflow inlet 402 is open such that airflow into the ventilation region is not restricted by the second air inlet (i.e. the second restrictor mechanism 404*a* is positioned to completely open the second air inlet 402), similarly to the example of FIG. 1, if the user draws on the consumable article when the size of the first air inlet 112 is relatively small, there is a relatively large airflow into the ventilation region 108. On the other hand, when the second air inlet 402 is completely open, if the user draws on the consumable article 102 when the size of the first air inlet 112 is relatively large, there is a relatively small amount of airflow into the ventilation region 108. In the example of FIG. 4, additionally, the amount of airflow into the ventilation region may be controlled by controlling the amount of airflow through the second air inlet 402 using the second airflow control arrangement 404. For example, for a given size of the first air inlet 112, the size of the second air inlet 402 may be varied to further control the amount of consumable ventilation 402. For a given size of the first air inlet 112, additionally controlling the amount of consumable ventilation 402 may control the draw resistance of the consumable article 102.

Also, for example, when the second restrictor mechanism 404*a* is positioned to fully close the second air inlet 402, the size of the first air inlet 112 may be varied in order to control the draw resistance of the consumable article 102.

Figure 5:
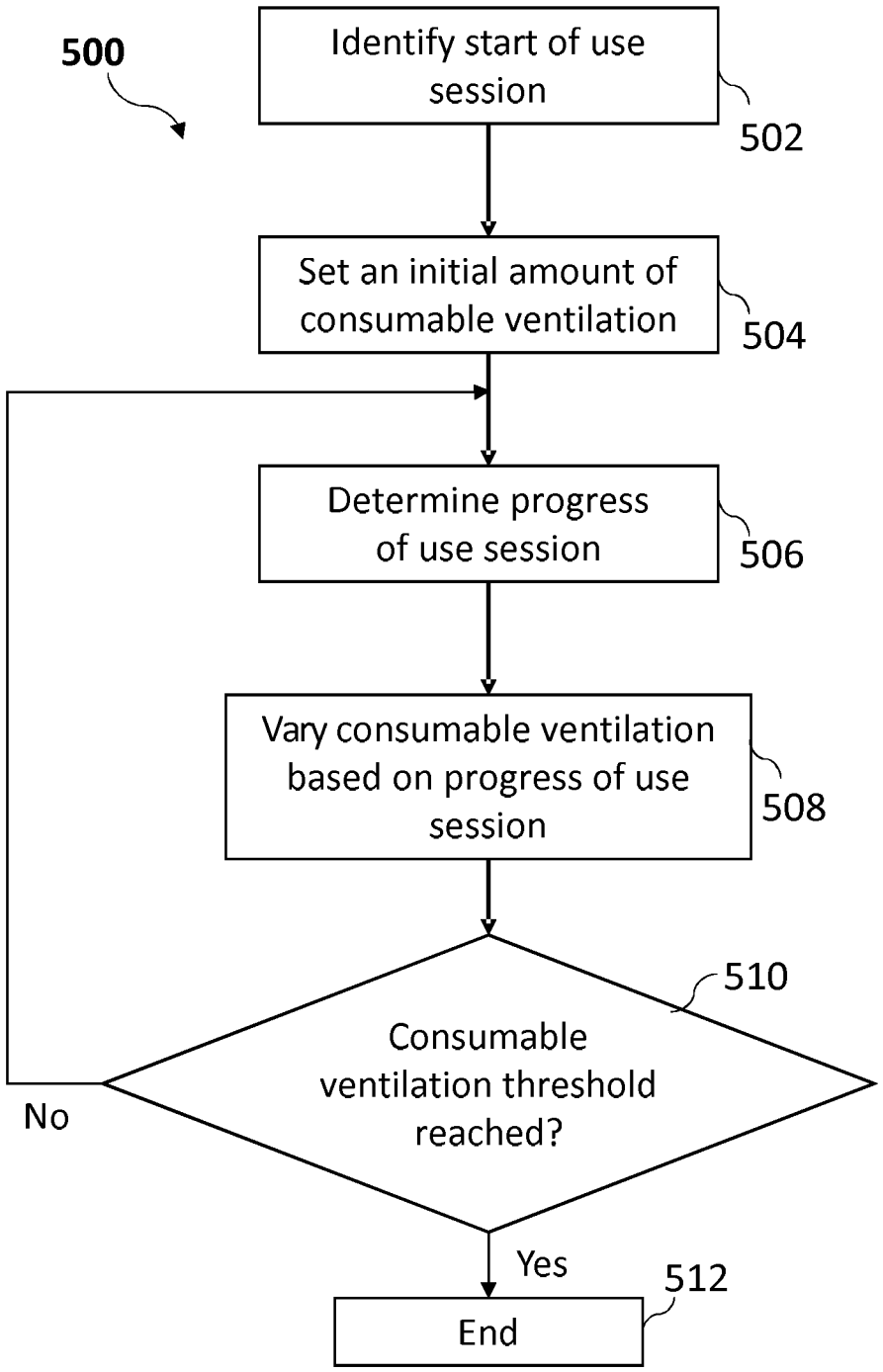
FIG. 5 is a flow diagram illustrating a method of controlling ventilation of a consumable article.

A method of controlling the ventilation of the consumable article 102 of the system 100 or system 400 will now be described. FIG. 5 is a flow diagram illustrating a specific example method 500 for controlling the ventilation of the consumable article 102. At 502 of the method 500, the start of a use session is identified. For example, the control circuitry 116 may identify the start of the use session to occur at the time at which the user initiates heating of the aerosolizable material 106 of consumable article 102 inserted into the apparatus 104. At 504, an initial amount of consumable ventilation is set by setting an initial size of the first air inlet 112 (or otherwise setting the amount of airflow allowed through the first air inlet 112). For example, the controller 116 controls the first actuator 114*b* to move the first restrictor mechanism 114*a* to control the size of the first air inlet 112 such that the desired initial amount of consumable ventilation is achieved when the user draws on the consumable article 102. In the example in which the controller 116 is configured to manage the initial phase of the use session so that the temperature of the aerosol flow into the mouth of the user is not uncomfortably hot, the initial amount of consumable ventilation may be a large amount, for example, the consumable ventilation may be set to the maximum ventilation of the consumable article 102 the system 100 is configured to provide. In some examples, the initial consumable ventilation may be set to an amount less than the maximum consumable ventilation system 100 is configured to provide.

At 506, the progress of the use session is determined. In some examples, the control circuitry 116 determines the progress of the use session based on the time elapsed since the start of the use session. In examples in which monitor 122 is provided for use in determining the progress of use sessions, the control circuitry 116 determines the progress of the use session based on signals received from the monitor 122.

In the examples in which monitor 122 is a pressure sensitive device (i.e. a puff detector or a microphone), the controller 116 determines the number of puffs, i.e. instances of aerosol being drawn from the consumable article 102, that have taken place based on the data received from the monitor 122. The controller may receive data from the monitor 122 each time data indicating pressure variation that may indicate a puff being taken is acquired by the monitor 122. In some examples, the controller 116 may periodically request data from the monitor 122. In some examples, the controller 116 may receive data from the monitor 122 in real time and/or continuously.

At 508, consumable ventilation is varied based on the progress of the use session by varying the size of the first air inlet 112. In examples in which the controller 116 is configured to manage the temperature of the aerosol flow so that it is not uncomfortably hot for a user in the early stages of a use sessions, the consumable ventilation is decreased as the use session progresses. The consumable ventilation is decreased by increasing the size of the first air inlet 112. For example, the control circuitry 116 decreases consumable ventilation by causing first actuator 114*b* to move the first restrictor mechanism 114*a* in the direction of the arrow 126 in order to increase the size of the first air inlet 112 as the number of puffs taken by the user increases as determined using the monitor 122.

A correspondence relationship between the number of puffs taken and the amount of consumable ventilation to be provided may be used by the controller 116 in order to determine how the consumable ventilation varies as a function of the number of puffs taken. FIG. 6 shows table 600 which indicates such a correspondence relationship. In table 600, column 602 indicates use session progress in the form of puff number taken by the user. Column 604 indicates the percentage of the first air inlet 112 of the apparatus 104 that is to be closed, in other words the percentage by which the size of the first air inlet 112 is to be decreased, using the first restrictor mechanism 114*a* for the corresponding puff number taken as indicated in column 602. Column 606 indicates the amount of air flowing into the first air inlet 112 as a percentage of the total air drawn into the apparatus 104 through the first air inlet 112 and the ventilation region 108 of the consumable article 102 as a result of the corresponding air inlet size shown in column 604 when the user takes a puff. In other words, column 606 indicates the desired percentage of the total air drawn into the apparatus 104 and the consumable article 102 that is drawn into the first air inlet 112 when the corresponding puff number indicated in column 602 is taken by the user. Finally, column 608 indicates the amount of air flowing into the ventilation region 108 as a percentage of the total air drawn into the apparatus 104 through the first air inlet 112 and the ventilation region 108 of the consumable article 102 as a result of the corresponding air inlet size shown in column 604 when the user takes a puff. In other words, column 608 indicates the desired percentage of the total air drawn into the apparatus 104 and the consumable article 102 that is drawn into the consumable article 102 through ventilation region 108 when the corresponding puff number indicated in column 602 is taken by the user.

It will be understood that the correspondence relationship shown in table 600 is intended to cause a large initial amount of consumable ventilation at the start of the use session, and to decrease the consumable ventilation as the use session progresses.

Table 600 of FIG. 6 shows a specific example of a correspondence relationship. However, in some examples, the correspondence relationship may indicate that the first air inlet 112 is to be mostly closed for the first 3 puffs and subsequently is to be mostly open as the use session progresses. In some examples in which the control circuitry 116 determines the progress of the use session based on the time elapsed since the start of the use session, the correspondence relationship may indicate that the first air inlet 112 is mostly closed for the first 60 seconds of the use session, and the size of the first air inlet 11 is increased gradually or incrementally thereafter. For example, the correspondence relationship may indicate that the first air inlet 112 is mostly open after the first 60 seconds of the use session. In some examples, the correspondence relationship indicates that the first air inlet is mostly closed for the first 10 to 50 seconds of a use session before the size of the first air inlet 112 is gradually or incrementally increased to decrease consumable ventilation. For example, the first air inlet 112 may be mostly open after the first 10 to 50 seconds of a use session. In some examples, the correspondence relationship indicates that the first air inlet is mostly closed for the first 20 to 40 seconds of a use session before the size of the first air inlet 112 is gradually or incrementally increased to decrease consumable ventilation. For example, the first air inlet 112 may be mostly open after the first 20 to 40 seconds of the use session. The terms "mostly open" or "mostly closed" in the examples refer to the size of the first air inlet 112 being relatively large and relatively small, respectively.

At 510 of the method 500, it is determined whether or not a consumable ventilation threshold is reached. The control circuitry 116 makes the determination of 510. The consumable ventilation threshold may indicate an amount of consumable ventilation that when reached should be maintained until the end of the use session. It will be understood that the consumable ventilation threshold would correspond to a threshold first air inlet 112 size, and therefore, whether or not the consumable ventilation threshold is reached may be determined based on the change in the size of the first air inlet 112 with respect to the initial first air inlet 112 size at the beginning of the use session. If it is determined that the consumable ventilation threshold has not been reached, the method 500 returns to 506 to determine the progress of the use session, and 506 to 510 are repeated. If it is determined that the consumable ventilation threshold has been reached, the method 500 ends at 512.

In some examples, the consumable ventilation may be varied such that the same amount of consumable ventilation is set at different points through the use session. For example, the consumable ventilation may be decreased from an initial amount as the use session progresses, and may then be increased as the use session continues to progress. The consumable ventilation may be controlled in this way, for example, to control the flavor of the aerosol as the use session progresses. In such examples, the consumable ventilation threshold may not merely define an amount of consumable ventilation (i.e. a particular first air inlet 112 size) but may also be indicative of how the consumable ventilation has been varied since the start of the use session. Thus, in these examples, the control circuitry 116 may determine whether or not the consumable ventilation threshold has been reached based on the current amount of consumable ventilation and the variation of the consumable ventilation since the beginning of the use session.

Although in the above examples reference has been made to controlling the ventilation of the consumable article 102 by controlling the size of the first air inlet 112, it should be appreciated that the consumable ventilation can be controlled by varying the airflow allowed through the first air inlet 112 which in the above examples is controlled by varying the size of the first air inlet 112. In other examples, various different methods of controlling the airflow through the first air inlet 112 (other than merely controlling the size of the first air inlet 112) may be used. In examples comprising a second air inlet 402, such as that of system 400, both the first air inlet 112 and the second air inlet 402 may together be controlled by the controller 116 to control consumable ventilation and achieve one or more of the above described results.

The various examples described herein are presented only to assist in understanding and teaching the claimed features. These examples are provided as a representative sample only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An apparatus for receiving an article comprising aerosolizable material and a ventilation region, in which apparatus the aerosolizable material can be heated to volatilize at least one component of the aerosolizable material to generate a flow of aerosol for inhalation by a user, the apparatus comprising:

a housing into which the article can be inserted to be heated;

a first opening in the housing to allow air to flow into the housing when a user draws on the apparatus or the article;

a first airflow control arrangement configured to, in use, when the article is inserted in the housing, control an amount of airflow through the first opening in the housing in order to control an amount of airflow passing into the article through the ventilation region; and a controller configured to control ventilation of the article inserted into the apparatus by controlling an operation of the first airflow control arrangement, wherein the controller is configured to control the first airflow control arrangement to allow a given amount of airflow through the first opening at a beginning of a use session, and to control the first airflow control arrangement to increase the amount of airflow through the first opening as the use session progresses.

2. The apparatus according to claim 1, wherein the first airflow control arrangement comprises an airflow control mechanism configured to control the airflow through the first opening by varying a size of the first opening.

3. The apparatus according to claim 2, wherein the first airflow control arrangement comprises a first restrictor mechanism operatively connected to a first actuator configured to actuate the first restrictor mechanism.

4. The apparatus according to claim 1, further comprising a monitor for use in determining progress of a use session.

5. The apparatus according to claim 4, wherein the monitor is a pressure sensitive device configured to count a number of times the volatilized at least one component of aerosolizable material is drawn from the apparatus.

6. The apparatus according to claim 4, wherein the controller controls the first airflow control arrangement on the basis of the progress of the use session determined using the monitor.

7. The apparatus according to claim 4, further comprising a setting input arrangement configured to receive an indication of settings for varying the amount of airflow through the first opening as the use session progresses, and wherein the controller is configured to control the first airflow control arrangement based on settings received via the setting input arrangement.

8. The apparatus according to claim 1, wherein the ventilation region is positioned within the apparatus when the article is inserted into the apparatus, and the housing comprises a second opening to allow air to flow to the ventilation region.

9. The apparatus according to claim 8, further comprising a second airflow control arrangement configured to, in use, when the article is inserted in the housing, control an amount of airflow through the second opening in the housing in order to control an amount of airflow passing into the article through the ventilation region.

10. The apparatus according to claim 1, further comprising at least one heater arrangement within the housing for heating the aerosolizable material of the article.

11. A method of controlling ventilation of an article inserted into an apparatus for heating aerosolizable material to volatilize at least one component of the aerosolizable material to generate a flow of aerosol for inhalation by a user, the method comprising:

varying an amount of airflow through an air inlet of the apparatus in order to vary an amount of ventilation airflow passing into the article through a ventilation region in the article, wherein a given amount of airflow is allowed through the air inlet at a beginning of a use session, and wherein the amount of airflow through the air inlet increases as the use session progresses.

12. The method according to claim 11, further comprising:

identifying a start of a use session; and setting an initial amount of ventilation of the article by setting an initial airflow through the air inlet of the apparatus.

13. The method according to claim 12, further comprising repeatedly:

determining progress of the use session; and varying the ventilation of the article by varying the airflow through the air inlet of the apparatus based on the progress of the use session until a ventilation threshold is reached.

14. A system for heating aerosolizable material to volatilize at least one component of the aerosolizable material to generate a flow of aerosol for inhalation by a user, the system comprising:

an article comprising a body of aerosolizable material and a ventilation region to enable a flow of air into the article; and an apparatus in which the aerosolizable material of the article can be heated, the apparatus comprising:

a housing into which the article can be inserted to be heated;

a first opening in the housing to allow air to flow into the housing when the user draws on the apparatus or the article; and a first airflow control arrangement configured to, in use, when the article is inserted in the housing, control an amount of airflow through the first opening in the housing in order to control an amount of airflow passing into the article through the ventilation region; and a controller configured to control ventilation of the article inserted into the apparatus by controlling an operation of the first airflow control arrangement, wherein the controller is configured to control the first airflow control arrangement to allow a given amount of airflow through the first opening at a beginning of a use session, and to control the first airflow control arrangement to increase the amount of airflow through the first opening as the use session progresses.

15. An apparatus for receiving an article comprising aerosolizable material and a ventilation region, such that in the apparatus the aerosolizable material can be heated to volatilize at least one component of the aerosolizable material to generate a flow of aerosol for inhalation by a user, the apparatus comprising:

a housing into which the article can be inserted to be heated;

a first opening in the housing to allow air to flow into the housing when a user draws on the apparatus or the article;

a first airflow control arrangement configured to, in use and when the article is inserted in the housing, control an amount of airflow through the first opening in the housing in order to control an amount of airflow passing into the article through the ventilation region;

a controller configured to control ventilation of the article inserted into the apparatus by controlling an operation of the first airflow control arrangement; and a setting input arrangement configured to receive from a user an indication of settings for varying the amount of airflow through the first opening as a use session progresses, wherein the controller is configured to control the first airflow control arrangement based on settings received via the setting input arrangement.

16. A method of controlling ventilation of an article inserted into an apparatus for heating aerosolizable material to volatilize at least one component of the aerosolizable material to generate a flow of aerosol for inhalation by a user, the method comprising:

receiving from a user an indication of settings for varying an amount of airflow through an air inlet of the apparatus as a use session progresses; and varying the amount of the airflow through the air inlet, based the indication of settings, in order to vary an amount of ventilation airflow passing into the article through a ventilation region in the article.

17. A system for heating aerosolizable material to volatilize at least one component of the aerosolizable material to generate a flow of aerosol for inhalation by a user, the system comprising:

an article comprising a body of the aerosolizable material and a ventilation region to enable a flow of air into the article; and an apparatus in which the aerosolizable material of the article can be heated, the apparatus comprising:

a housing into which the article can be inserted to be heated;

a first opening in the housing to allow air to flow into the housing when the user draws on the apparatus or the article;

a first airflow control arrangement configured to, in use and when the article is inserted in the housing, control an amount of airflow through the first opening in the housing in order to control an amount of airflow passing into the article through the ventilation region;

a controller configured to control ventilation of the article inserted into the apparatus by controlling an operation of the first airflow control arrangement; and a setting input arrangement configured to receive from a user an indication of settings for varying the amount of airflow through the first opening as the use session progresses, wherein the controller is configured to control the first airflow control arrangement based on settings received via the setting input arrangement.

18. A system for heating aerosolizable material to volatilize at least one component of the aerosolizable material to generate a flow of aerosol for inhalation by a user, the system comprising:

an article comprising a body of the aerosolizable material and a ventilation region to enable a flow of air into the article, wherein the ventilation region is between a proximal end and the aerosolizable material, in a cooling segment; and an apparatus in which the aerosolizable material of the article can be heated, the apparatus comprising:

a housing into which the article can be inserted to be heated, wherein the ventilation region is outside the housing when the article is inserted in the housing to be heated;

an opening in the housing to allow air to flow into the housing when the user draws on the apparatus or the article; and an airflow control arrangement configured to, in use, when the article is inserted in the housing, control an amount of airflow through the opening in the housing in order to control an amount of airflow passing into the article through the ventilation region.

19. A method of controlling the ventilation of an article inserted into an apparatus for heating aerosolizable material to volatilize at least one component of the aerosolizable material to generate a flow of aerosol for inhalation by a user, the method comprising:

inserting the article into a housing of the apparatus to be heated;

varying an amount of airflow through an air inlet of the apparatus in order to vary an amount of ventilation airflow passing into the article through a ventilation region in the article, wherein the ventilation region is between a proximal end and the aerosolizable material comprised in the article, in a cooling segment and wherein the ventilation region is outside the housing when the article is inserted in the housing to be heated.

* * * * *